US010920342B2

(12) United States Patent
Matsumoto et al.

(10) Patent No.: US 10,920,342 B2
(45) Date of Patent: Feb. 16, 2021

(54) LOOM, METHOD FOR PRODUCING TEXTILE, AND ULTRAHIGH-DENSITY TEXTILE

(71) Applicant: JIAXING DEYONG TEXTILES CO., LTD., Zhejiang (CN)

(72) Inventors: Yasuhiro Matsumoto, Zhejiang (CN); Shunzo Kawasaki, Zhejiang (CN)

(73) Assignee: JIAXING DEYONG TEXTILES CO., LTD., Zhejiang (CN)

( * ) Notice: Subject to any disclaimer, the term of this patent is extended or adjusted under 35 U.S.C. 154(b) by 15 days.

(21) Appl. No.: 16/341,647

(22) PCT Filed: Oct. 21, 2016

(86) PCT No.: PCT/CN2016/102858
§ 371 (c)(1),
(2) Date: Apr. 12, 2019

(87) PCT Pub. No.: WO2018/072200
PCT Pub. Date: Apr. 26, 2018

(65) Prior Publication Data

US 2019/0382930 A1 Dec. 19, 2019

(51) Int. Cl.
*D03D 49/00* (2006.01)
*D03D 47/12* (2006.01)
(Continued)

(52) U.S. Cl.
CPC ..... *D03D 47/12* (2013.01); *D03D 15/00* (2013.01); *D03D 41/00* (2013.01); *D03D 47/18* (2013.01);
(Continued)

(58) Field of Classification Search
CPC ..... D03D 15/00; D03D 13/008; D03D 1/00; D03D 49/04; D03D 11/00; D03D 49/12;
(Continued)

(56) References Cited

U.S. PATENT DOCUMENTS 3,414,020 A * 12/1968 Fend ..... D03D 47/268 139/436
3,695,304 A * 10/1972 Menegatto ..... D03C 5/02 139/78
(Continued)

FOREIGN PATENT DOCUMENTS

CN 2623722 Y 7/2004
CN 101008124 A 8/2007
(Continued)

OTHER PUBLICATIONS

PCT/ISA/210, "International Search Report for International Application No. PCT/CN2016/102858," dated Dec. 29, 2016.
(Continued)

*Primary Examiner* — Robert H Muromoto, Jr.
(74) *Attorney, Agent, or Firm* — Manabu Kanesaka

(57) ABSTRACT

A loom capable of weaving an ultra-high density textile includes: multiple heddles which make some warps of multiple warps separated from other warps; a weft guiding portion making wefts pass through an opening; a reed pressing the wefts passing through the opening towards a fell so as to form a textile; a feeding roller which feeds the warps to the heddles at a position that deviates and staggers from an imaginary plane passing through the center of the moving range of the heddles and the fell; a delivery loom beam delivering the warps to the feeding roller; and a textile winding loom beam winding the textile, when the heddles is at the center, the tension of the warps being set as 0.32 cN/dTex or more and 0.38 cN/dTex or less.

4 Claims, 4 Drawing Sheets

(51) Int. Cl.

| | |
|---|---|
| ***D03D 15/00*** | (2021.01) |
| ***D03D 41/00*** | (2006.01) |
| ***D03D 49/18*** | (2006.01) |
| ***D03D 47/18*** | (2006.01) |
| *D03D 1/00* | (2006.01) |
| *D06P 3/52* | (2006.01) |

(52) U.S. Cl.
CPC ..... *D03D 49/18* (2013.01); *D06P 3/52* (2013.01); *D10B 2331/04* (2013.01)

(58) Field of Classification Search
CPC .. D03D 39/223; D03D 47/267; D03D 47/268; D03D 49/06; D03D 13/00; D03D 49/00; D03D 47/12; D03D 41/00; D03D 47/18; D06P 3/52; D10B 2331/04; D03C 3/20
See application file for complete search history.

(56) References Cited

U.S. PATENT DOCUMENTS

| | | | | | |
|---|---|---|---|---|---|
| 4,135,554 | A * | 1/1979 | Gotoh | D03D 51/32 | 139/337 |
| 4,548,848 | A * | 10/1985 | Shibata | D03D 1/00 | 139/383 R |
| 4,815,504 | A * | 3/1989 | Linka | D03D 47/267 | 139/436 |
| 4,848,412 | A * | 7/1989 | Pittman | D03D 13/00 | 139/383 R |
| 4,942,908 | A * | 7/1990 | Imamura | D03D 49/04 | 139/1 E |
| 4,957,142 | A * | 9/1990 | Houlon | D03C 9/00 | 139/82 |
| 5,014,756 | A * | 5/1991 | Vogel | D03D 49/12 | 139/102 |
| 5,421,378 | A * | 6/1995 | Bowers | B60R 21/235 | 139/100 |
| 5,466,514 | A * | 11/1995 | Kataoka | A41D 31/00 | 139/383 R |
| 6,704,980 | B1 * | 3/2004 | Yamamoto | D02H 13/28 | 28/178 |
| 7,690,401 | B2 * | 4/2010 | Okuno | D03D 1/02 | 139/384 R |
| 9,211,865 | B2 * | 12/2015 | Furuniwa | D03D 1/02 | |
| 10,233,573 | B2 * | 3/2019 | Beauduin | D03D 27/06 | |
| 10,239,481 | B2 * | 3/2019 | Yamada | D03D 1/02 | |
| 10,259,421 | B2 * | 4/2019 | Ise | D06C 15/08 | |
| 10,385,482 | B2 * | 8/2019 | Ise | D03D 1/02 | |
| 10,544,527 | B2 * | 1/2020 | Horiuchi | D03D 1/00 | |
| 2002/0033198 | A1 * | 3/2002 | Nahir | D03C 9/02 | 139/425 R |
| 2003/0008582 | A1 * | 1/2003 | Koketsu | D03D 15/00 | 442/195 |
| 2005/0170723 | A1 * | 8/2005 | Okada | D01F 6/60 | 442/189 |
| 2007/0007756 | A1 * | 1/2007 | Okuno | B60R 21/235 | 280/743.1 |
| 2009/0277529 | A1 * | 11/2009 | Borer | D03C 13/00 | 139/455 |
| 2015/0017859 | A1 * | 1/2015 | Akechi | D03D 13/008 | 442/208 |
| 2015/0246655 | A1 * | 9/2015 | Furuniwa | B60R 21/235 | 139/420 R |
| 2015/0329998 | A1 * | 11/2015 | Ise | D06C 15/00 | 280/743.1 |
| 2016/0193979 | A1 * | 7/2016 | Ise | D06M 13/513 | 280/743.1 |
| 2016/0194790 | A1 * | 7/2016 | Ise | B60R 21/235 | 139/420 A |
| 2018/0080152 | A1 * | 3/2018 | Horiuchi | D03D 1/0035 | |
| 2018/0086300 | A1 * | 3/2018 | Yamada | D03D 15/00 | |
| 2019/0015192 | A1 * | 1/2019 | Nakazawa | D03D 3/02 | |

FOREIGN PATENT DOCUMENTS

| | | | |
|---|---|---|---|
| CN | 201459342 | U | 5/2010 |
| CN | 201546002 | U | 8/2010 |
| CN | 103194844 | A | 7/2013 |
| CN | 103806158 | A | 5/2014 |
| CN | 105671726 | A | 6/2016 |
| EP | 0350447 | A1 | 1/1990 |
| FR | 928471 | A | 11/1947 |
| JP | S54-131073 | A | 10/1979 |
| JP | H01-250439 | A | 10/1989 |
| JP | H04-300347 | A | 10/1992 |
| JP | H10-331057 | A | 12/1998 |
| JP | 2001-123355 | A | 5/2001 |
| JP | 2002-180354 | A | 6/2002 |
| JP | 2003-183946 | A | 7/2003 |
| JP | 2003-183948 | A | 7/2003 |
| JP | 4147450 | B2 | 9/2008 |
| JP | 2016-089293 | A | 5/2016 |

OTHER PUBLICATIONS

PCT/ISA/237, "Written Opinion of the International Searching Authority for International Application No. PCT/CN2016/102858," dated Dec. 29, 2016.

Europe Patent Office, "Search Report for European Patent Application No. 16919207.7," dated Mar. 31, 2020.

Japan Patent Office, "Office Action for Japanese Patent Application No. 2019-503452," dated Jun. 23, 2020.

China Patent Office, "Office Action for Chinese Patent Application No. 201680089207.8," dated Oct. 21, 2020.

* cited by examiner

LOOM, METHOD FOR PRODUCING TEXTILE, AND ULTRAHIGH-DENSITY TEXTILE

RELATED APPLICATIONS

The present application is National Phase of International Application No. PCT/CN2016/102858 filed Oct. 21, 2016, the disclosure of which is hereby incorporated by reference herein in its entirety.

TECHNICAL FIELD

The present invention relates to a technique involved in weaving, and a technique involved in a preparatory treatment for sewing.

BACKGROUND ART

Looms with which warps and wefts are interwoven to produce textiles have been conventionally known (Patent Literature 1, for example).

CITATION LIST

Patent Literature

Patent Literature 1: JP2001-123355

SUMMARY OF INVENTION

Technical Problem

When a textile is used in a feather product, a low yarn density of such a textile may result in feathers coming out from between the yarns. In view of this, a technique capable of weaving a high-density textile has been demanded.

When clothes or the like are sewn using a high-density textile, the textile is subjected to dyeing, a water repellent treatment, calendering, and the like as preparatory treatments for sewing. A technique capable of reducing the cost of such preparatory treatments for sewing has also been demanded.

It is an object of the present invention to provide a technique capable of weaving a high-density textile and a technique capable of reducing the cost of preparatory treatments in the sewing of a high-density textile.

Solution to Problem

A loom of the present invention includes: a plurality of heddles that separate a part of a plurality of warps from the other part of the plurality of warps to form a shed between the part of the warps and the other part of the warps, each of the warps being a polyester yarn; a weft inserting unit that makes a weft pass through the shed, the weft being a polyester yarn; a reed that presses the weft, having been passed through the shed, against a fell to make a textile; a feeding roller that feeds the warps to the heddles from a position displaced from an imaginary plane passing through a center of a moving range of the heddles and the fell; a let-off beam that feeds the warps to the feeding roller; and a textile winding beam that winds the textile. A tension of the warps when the heddles are located at the center is set to 0.32 cN/dtex or more and 0.38 cN/dtex or less.

A path of the warps from the feeding roller to the heddles is diverged into two paths by the heddles. According to the present invention, the feeding roller feeds the warps to the heddles from the position displaced from the imaginary plane connecting between the center of the moving range of the heddles and the fell. This makes a path (referred to as a first path) along which the warps move on a side opposite to the position of the feeding roller at which the warps are let off with respect to the imaginary plane longer than a path (referred to as a second path) along which the warps move on the same side as the let-off position with respect to the imaginary plane.

Thus, when each peddle moves to the center of the moving range, the warp moving along the first path loosens more than the warp moving along the second path. When a weft, having been passed through the shed between such warps, is pressed against the fell by the reed in such a state, the weft and the warps that intersect with this weft are woven into the textile. At this time, since the warp moving along the first path is looser than the warp moving along the second path according to the present invention, the warp on the first path is woven into the textile with a bend larger than that of the conventional techniques having equal warp path lengths. By weaving the textile in this manner, the warps on the first path are woven with a larger bend than that in the conventional techniques. As the bend of the warp increases, a distance between the wefts in a drawing direction of the warp decreases. Thus, the density of the wefts (i.e., the density of the textile) can be increased.

If the tension of the warps when the heddles are located at the center of the moving range is lower than 0.32 cN/dtex, the part of the warps and the other part of the warps, which are separated from each other by the heddles, are both likely to loosen. Thus, even when a tension difference is provided between the part of the warps and the other part of the warps, it is unable to increase only the bend of the warps on the first path, thus failing to increase the density of the wefts.

If the tension of the warps when the heddles are located at the center of the moving range is higher than 0.38 cN/dtex, on the other hand, a frictional resistance at a portion where the reed is in contact with the warps becomes excessively high when the reed presses the weft against the fell, thereby causing a problem such as the shaving of the warp or the cutting of the warp. Moreover, in the case of weaving by a dobby method, it may be difficult to form the shed by the heddles if the tension of the warps is higher than 0.38 cN/dtex. Therefore, according to the present invention, the tension of the warps when the heddles are located at the center of the moving range is set to 0.32 cN/dtex or more and 0.38 cN/dtex or less in order to solve the aforementioned problems. The tension of the warps when the heddles are located at the center of the moving range may be set before the start of weaving. The tension of the warps may or may not be controlled by a controller during weaving. When the tension of the warps is uncontrolled, the feeding roller, the let-off beam, and the textile winding beam each have a constant rotational speed or a periodically-changing rotational speed.

According to the present invention, a controller may be provided. The controller may monitor the tension of the warps, and may control a rotational speed of at least one of the let-off beam and the textile winding beam so that the tension of the warps when the heddles are located at the center of the moving range has a value larger than or equal to 0.32 cN/dtex and smaller than or equal to 0.38 cN/dtex.

According to the present invention, the tension of the warps when the heddles are located at the center of the moving range can be controlled to be 0.32 cN/dtex or more and 0.38 cN/dtex or less by the controller. This can achieve reduced occurrence of yarn breakage and an increased density of wefts more reliably.

According to a method for producing a textile in the present invention, a feeding roller feeds a plurality of warps to heddles from a position displaced from an imaginary plane connecting between a center of a moving range of the heddles and a fell, where each of the warps is a polyester yarn. The heddles then separate a part of the plurality of warps from the other part of the plurality of warps to form a shed between the part of the warps and the other part of the warps. A weft, which is a polyester yarn and has been passed through the shed, is pressed against a fell to make a textile. Here, a tension of the warps when the heddles are located at the center of the moving range is set to 0.32 cN/dtex or more and 0.38 cN/dtex or less.

According to the producing method of the present invention, the density of wefts (i.e., the density of a textile) can be increased while the occurrence of warp breakage is reduced as with the above-described loom of the present invention. According to the present invention, by covering feathers with a textile having an increased density of wefts, the feathers can be prevented from coming out from between yarns of the textile. According to the conventional techniques, a textile is subjected to calendering so as to reduce a gap between yarns. According to the present invention, however, such calendering can be omitted since the density of the wefts can be increased. Thus, the cost of preparatory treatments for sewing can be reduced.

To implement the loom of the present invention, it is only necessary, as compared to the conventional loom, that the position of the feeding roller is adjusted and the tension of the warps is set to 0.32 cN/dtex or more and 0.38 cN/dtex or less. Thus, the cost of remodeling a loom or the cost of producing a loom can be reduced according to the present invention.

According to the producing method of the present invention, a water repellent treatment liquid containing 2 wt % or more of a smoothing agent is applied to the textile.

In a high-density textile, a pressure at a point of contact between a warp and a weft increases, thereby making the textile stiff. This may lower the tear strength of the textile. According to the present invention, the water repellent treatment liquid containing the smoothing agent is applied to such a high-density textile. Thus, the pressure at the point of contact between the warp and the weft can be prevented from increasing due to the action of the smoothing agent. Therefore, the tear strength of the textile can be increased.

Here, reference tear strengths of a textile both in a warp direction and a weft direction are generally 1 kg or more regardless of its yarn thickness, textile weave, or finishing method. Since the water repellent treatment liquid containing 2 wt % or more of the smoothing agent is applied to the textile according to the present invention, the tear strengths of the textile in the warp direction and the weft direction can be both raised to 1 kg or more.

According to an ultrahigh-density textile of the present invention, a warp and a weft are each a polyester yarn, and the textile is dyed and has a cover factor of 2760 to 2900 in a single-layered fabric. The ultrahigh-density textile of the present invention may be a single-layered fabric or a two-layered fabric, for example. When the ultrahigh-density textile is a two-layered fabric, a cover factor in the two-layered fabric is calculated and a half of the cover factor corresponds to a cover factor in a single-layered fabric.

If feathers are covered with a dyed textile having a cover factor smaller than 2760, some feathers come out from between yarns of the textile. Since the ultrahigh-density textile of the present invention has a cover factor larger than or equal to 2760, feathers can be prevented from coming out when the feathers are covered with the ultrahigh-density textile of the present invention. If the ultrahigh-density textile of the present invention is used for clothes, such an ultrahigh-density textile can prevent an acicular twig or the like from penetrating into the textile even when a wearer of the clothes steps into a thicket or the like. If the ultrahigh-density textile of the present invention is used for a surgical gown, the ultrahigh-density textile can prevent the penetration of blood.

In a textile having a cover factor higher than 2900, yarn breakage is more likely to occur at the time of weaving. Since the ultrahigh-density textile of the present invention has a cover factor smaller than or equal to 2900, weaving can be performed in a stable manner.

According to the ultrahigh-density textile of the present invention, the diameter of the weft may be set to 90 to 95% of the diameter of the warp. According to the present invention, since the diameter of the weft is smaller than the diameter of the warp by 5 to 10%, water pressure resistance can be improved as compared to a case where the weft and the warp have the same thickness.

DESCRIPTION OF EMBODIMENTS

Hereinafter, embodiments will be described with reference to drawings.

First Embodiment

Figure 1:
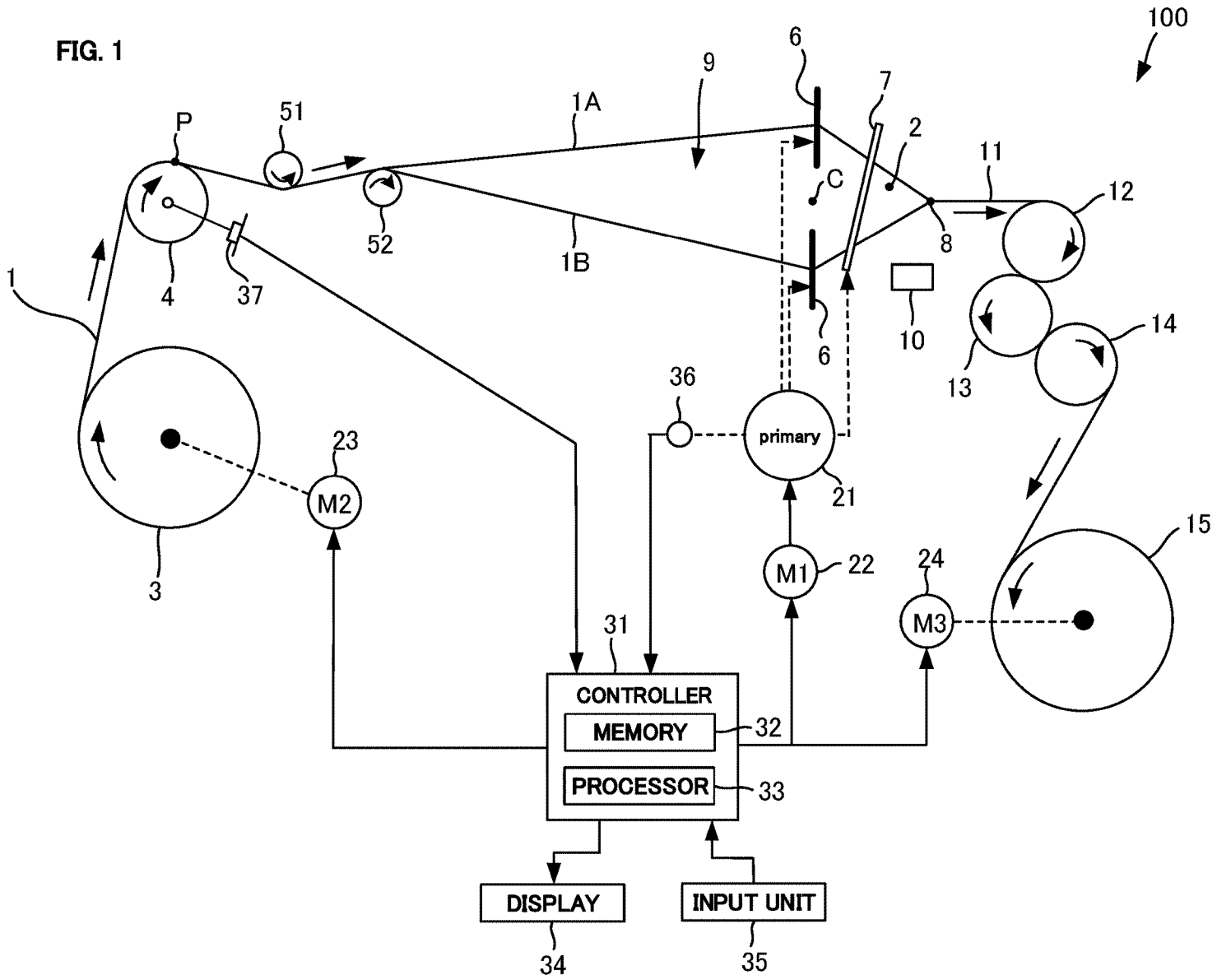
FIG. 1 is a diagram illustrating a configuration of a loom.

FIG. 1 is a diagram illustrating a configuration of a loom 100.

In the loom 100, a let-off beam 3 lets off a plurality of warps 1 to a back roller 4 (a feeding roller in the present invention). The warp 1 is a polyester yarn, and a false-twisted yarn (DTY (draw textured yarn)), for example. A yarn having physical properties shown in Table 1 below, for example, may be employed as the warp 1 of the present embodiment.

TABLE 1

| | |
|---|---|
| TENSILE STRENGTH | 3.8~5.3 cN/dtex |
| WET-DRY STRENGTH RATIO | 100% |
| ELONGATION PERCENTAGE | 20~32% |
| ELASTIC RECOVERY | 95~100% |

TABLE 1-continued

| | |
|---|---|
| PERCENTAGE OF ELONGATION | (WHEN STRETCHED BY 3%) |
| INITIAL TENSILE RESISTIVITY | 79~141 cN/dtex |
| APPARENT YOUNG'S MODULUS | 1100~2000 kg/mm$^2$ |
| MOISTURE PERCENTAGE | 0.4% |
| THICKNESS | 33.3 OR 55.6 dtex |

The warps 1 travel from the back roller 4, through tension rollers 51 and 52, heddles 6, and a reed 7, to a fell 8. The fell 8 refers to a boundary between the warps 1 before being part of a textile 11 and the textile 11. The fell 8 extends in a direction perpendicular to the paper plane of FIG. 1.

The plurality of heddles 6 are provided and reciprocate vertically around a center C. The maximum moving distance of the heddle 6 when the heddle 6 moves upward from the center C is equal to the maximum moving distance of the heddle 6 when the heddle 6 moves downward from the center C. The total number of the heddles 6 is, for example, 2N (N is 2, 3, or 4), and a half of the heddles 6 move upward and the other half of the heddles 6 move downward. A driving method of the heddles 6 in the present embodiment is a tappet method in which the heddles 6 are driven by being in contact with cams. The heddles 6 locally separate a part of the plurality of warps 1 from the other part of the plurality of warps 1 vertically so as to forma shed 9 between the part of the warps 1 and the other part of the warps 1. The part of the warps 1 correspond to a half of the warps 1 when all the warps 1 are picked up every other warp, for example, and serve as upper yarns 1A. The other part of the warps 1 correspond to the unpicked remaining half of the warps 1 and serve as lower yarns 1B.

A weft inserting unit 10 in the present embodiment injects compressed water from a nozzle into the shed 9 together with a weft 2 according to a water jet method. Hereinafter, the insertion of the weft 2 into the shed 9 by the weft inserting unit 10 will be described as weft inserting.

Weft inserting is performed while each peddle 6 located at an upper end position or a lower end position moves to the center C. The weft 2 is a polyester yarn having the same thickness as the warp 1, and its physical properties are the same as those of the warp 1 shown in Table 1.

The reed 7 moves in a direction closer to the fell 8 (forward) or moves in a direction away from the fell 8 (backward). By moving forward, the reed 7 presses the weft 2, which has been passed through between the upper yarns 1A and the lower yarns 1B, against the fell 8. Hereinafter, pressing the weft 2 against the fell 8 by the reed 7 will be described as beating.

Beating is performed when each of the peddles 6 is located at a position near the center C.

By repeating the above-described series of motions, the warps 1 and the wefts 2 are interwoven at the fell 8, thus making the textile 11 at the fell 8. In the present embodiment, the loom 100 makes a plain-woven textile 11 in which a single warp intersects with a single weft in a staggered manner.

The textile 11 is wound by a textile winding beam 15 through a plurality of take-up rollers 12, 13, and 14.

Figure 2:
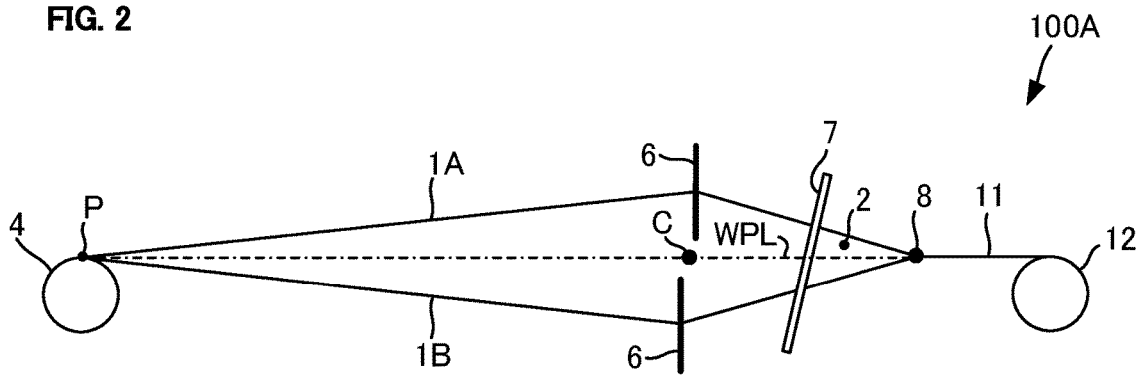
FIG. 2 is a diagram illustrating a configuration of a conventional loom from a back roller to a take-up roller.
Figure 3:
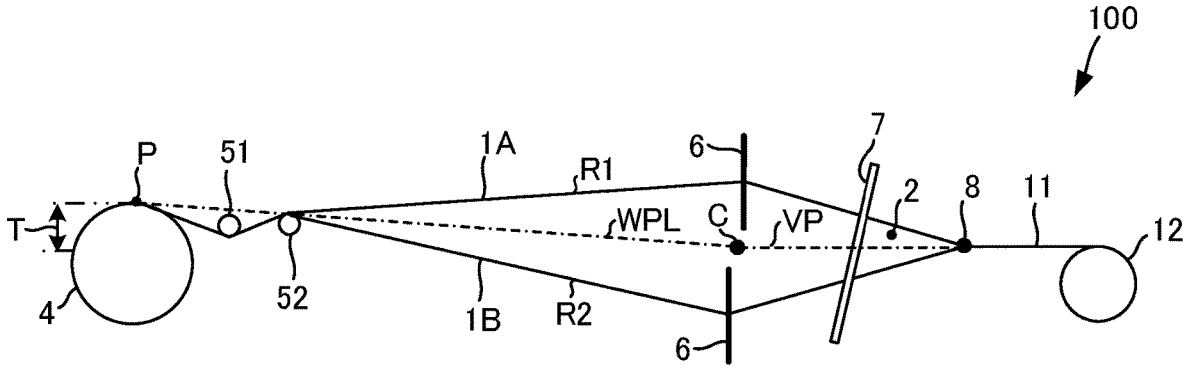
FIG. 3 is a diagram illustrating a configuration of a first embodiment from a back roller to a take-up roller.

Here, in a conventional loom 100A, a warp line WPL connecting a position P at which the back roller 4 lets off the warps 1, the center C of the heddles 6, and the fell 8 forms a straight line in a horizontal direction as illustrated in FIG. 2. In the present embodiment, on the other hand, the back roller 4 is placed, as illustrated in FIG. 3, at a position higher than the conventional position (the position of the back roller 4 illustrated in FIG. 2). The warp line WPL thus bends upward from the center C of the heddles 6 toward the back roller 4.

In other words, the back roller 4 feeds the warps 1 to the heddles 6 from a position P displaced upward by a distance T from an imaginary plane VP passing through the fell 8 and the center C of the heddles 6 (a portion of the warp line WPL ranging from the fell 8 to the center C of the heddles 6). The distance T in the present embodiment is set to 25.4 mm. The distance T, however, can be set to any appropriate value larger than 0 mm.

Placing the back roller 4 higher than in the conventional techniques makes a path R2 of the lower yarn 1B from the back roller 4 (the position P) to the peddle 6 at the lower end position longer than a path R1 of the upper yarn 1A from the back roller 4 (the position P) to the peddle 6 at the upper end position. Thus, when the peddles 6 move to the center C after weft inserting, the lower yarn 1B loosens more than the upper yarn 1A. Beating is performed in such a state.

Figure 4:
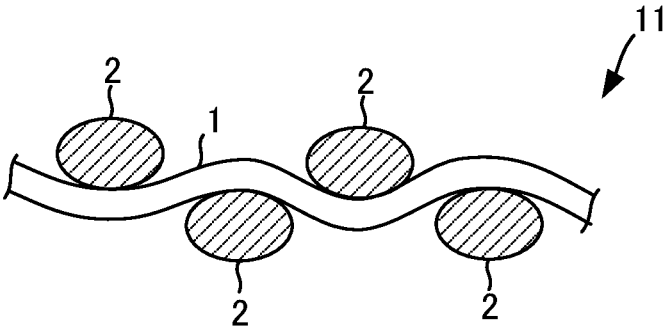
FIG. 4 is a diagram schematically illustrating a state of a warp in a textile.

FIG. 4 is a diagram schematically illustrating a state of the warp 1 in the textile 11.

Since the lower yarn 1B is looser than the upper yarn 1A, the lower yarn 1B intersects with the weft 2 with a bend larger than that of the upper yarn 1A accordingly. At the time of the next beating, the warps 1 intersect with the weft 2 with the warp 1 previously having served as the lower yarn 1B now serving as the upper yarn 1A and with the warp 1 previously having served as the upper yarn 1A now serving as the lower yarn 1B, thereby being woven into the textile 11. Each of the warps 1 is woven into the textile in accordance with such a cycle. During the period serving as the lower yarn 1B, the warp 1 is woven into the textile 11 in a loose state, i.e., in a state with a larger bend.

Figure 5:
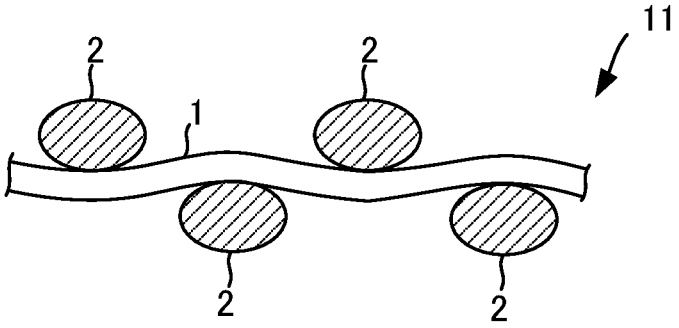
FIG. 5 is a diagram schematically illustrating a state of a warp in a conventional textile.

In terms of the whole cycle, each of the warps 1 is thus woven into the textile 11 with a larger bend as compared to the conventional techniques illustrated in FIG. 5 in which beating is performed with the paths R1 and R2 having the same length. Here, the distance between the wefts 2 in a drawing direction (the horizontal direction in FIG. 4) of the warp 1 decreases as the bend of the warp 1 increases. Thus, the present embodiment can increase the density of the wefts 2 over the conventional techniques since the warp 1 has a larger bend than in the conventional techniques.

Figure 6:
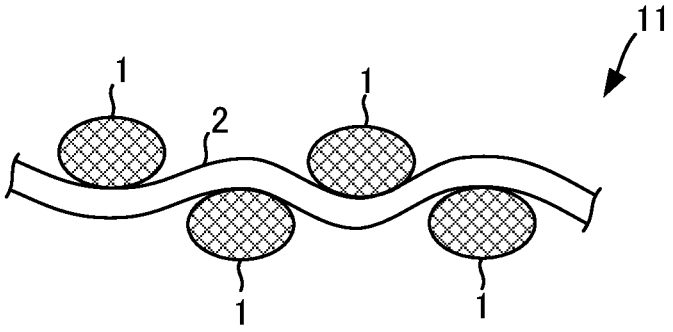
FIG. 6 is a diagram schematically illustrating a state of a weft in a textile.

Note that the weft 2 in the present embodiment is also woven into the textile 11 in a bent state as schematically illustrated in FIG. 6.

In the conventional loom, when weaving is performed with polyester yarns, the tension of the warps when the heddles 6 are located at the center C is set to 0.25 cN/dtex. In the present embodiment, the tension of the warps 1 when the heddles 6 are located at the center C is set to a value in a range of 0.32 to 0.38 cN/dtex in order to weave the textile 11 having an increased density of the wefts 2. More preferably, the tension of the warps 1 when the heddles 6 are located at the center C can be set to a value in a range of 0.32 to 0.35 cN/dtex. That is, the tension of the warps 1 in the present embodiment is set to a higher value than in the conventional techniques. The tension of the warps 1 depends on a diameter of the back roller 4. A larger diameter of the back roller 4 can achieve a higher tension of the warps 1. Thus, the diameter of the back roller 4 can be set so that the tension of the warps 1 when the heddles 6 are located at the center C falls within a range of 0.32 to 0.38 cN/dtex.

In the present embodiment, the tension rollers 51 and 52 are placed between the back roller 4 and the heddles 6 as illustrated in FIG. 1. The central axes of the tension rollers 51 and 52 are located higher than the imaginary plane VP passing through the fell 8 and the center C of the heddles 6. The diameter of each of the tension rollers 51 and 52 is smaller than that of the back roller 4. Placing the tension rollers 51 and 52 allows for adjustments in the tension of the warps 1, thus making it easier to set the tension of the warps 1 when the heddles 6 are located at the center C to be in a range of 0.32 to 0.38 cN/dtex.

If the tension of the warps 1 when the heddles 6 are located at the center C is higher than 0.38 cN/dtex, a frictional resistance at a portion where the reed 7 is in contact with the warps 1 becomes excessively high at the time of beating, thereby causing a problem such as the shaving of the warp 1 or the cutting of the warp 1. Moreover, in the case of weaving by a dobby method in which about 16 heddles 6 are moved up and down at appropriate timing, it may be difficult to form the shed 9 by the heddles 6 if the tension of the warps 1 when the heddles 6 are located at the center C is higher than 0.38 cN/dtex. Therefore, the tension of the warps 1 when the heddles 6 are located at the center C needs to be smaller than or equal to 0.38 cN/dtex.

If the tension of the warps 1 when the heddles 6 are located at the center C is lower than 0.32 cN/dtex, on the other hand, both of the upper yarn 1A and the lower yarn 1B are apt to loosen. Thus, even when a tension difference is provided between the upper yarns 1A and the lower yarns 1B in such a case, the bend of the warps 1 cannot be increased, thus failing to increase the density of the wefts 2. Therefore, the tension of the warps 1 when the heddles 6 are located at the center C needs to be larger than or equal to 0.32 cN/dtex in order to increase the density of the wefts 2.

If the tension of the warps 1 is increased by increasing the diameter of the back roller 4 without placing the tension rollers 51 and 52, the warps 1 let off from the let-off beam 3 may dig into the layers of the warps 1 wound around the let-off beam 3. By placing the tension rollers 51 and 52 as in the present embodiment, the tension of the warps 1 positioned between the back roller 4 and the let-off beam 3 can be reduced, thereby preventing the warps 1 let off from the let-off beam 3 from digging into the layers of the warps 1 wound around the let-off beam 3.

The tension of the warps 1 in the present embodiment is set higher than in the conventional techniques. Thus, the warps 1 become more likely to slide at the fell 8 due to variations in the tension of the warps 1, which are caused by the reciprocating movements of the heddles 6. In view of this, large take-up rollers having a diameter 1.5 times the diameter of the take-up roller 12 (take-up rollers 13 and 14 are not illustrated) employed in the conventional loom 100A of FIG. 2 are employed in the present embodiment as the take-up rollers 12 to 14. This can increase an area where the take-up rollers 12 to 14 are in contact with the textile 11, thereby reducing the sliding of the warps 1 at the fell 8.

The shedding motion of forming the shed 9 by the vertical reciprocating movements of the peddles 6, and the beating motion of performing beating by the back-and-forth reciprocating movements of the reed 7 are conducted by a kinetic energy transferred by the rotation of a primary shaft 21 of the loom 100. The shedding motion and the beating motion are conducted in conjunction with the rotation of the primary shaft 21. The primary shaft 21 is driven by a first motor 22 under the control of a controller 31.

The controller 31 includes a memory 32 and a processor 33 that performs various types of processing by loading programs in the memory 32 thereinto. The controller 31 controls the whole loom 100. In addition to the first motor 22, the controller 31 controls a display 34 to be described later, a second motor 23, and a third motor 24.

The display 34 displays setting information and operational statuses of the loom 100 under the control of the controller 31.

Examples of an input unit 35 are buttons or keys. The input unit 35 receives, from a user, inputs of commands for starting and stopping an operation of the loom 100 as well as inputs of settings, and outputs input signals to the controller 31.

An angle sensor 36 detects a rotation angle of the primary shaft 21, and outputs a detection signal representing the rotation angle to the controller 31.

A tension sensor 37 detects a load acting on the back roller 4, for example, as the tension of the warps 1, and outputs a detection signal representing the tension of the warps 1 to the controller 31.

The second motor 23 drives the let-off beam 3 under the control of the controller 31.

The third motor 24 drives the textile winding beam 15 under the control of the controller 31.

The controller 31 controls the second motor 23 and the third motor 24 so that the let-off beam 3 and the textile winding beam 15 are driven in synchronization with the rotation of the primary shaft 21. At this time, the controller 31 monitors the tension of the warps 1, and corrects rotational speeds of the let-off beam 3 and the textile winding beam 15 so that the tension of the warps 1 when the peddles 6 are located at the center C falls within a target range (a range of 0.32 to 0.38 cN/dtex).

When the tension of the warps 1 is below the lower limit (0.32 cN/dtex) of the target range, the controller 31 decreases a speed of letting off the warps 1 by the let-off beam 3, or increases a speed of winding the textile 11 by the textile winding beam 15. This can raise the tension of the warps 1.

When the tension of the warps 1 exceeds the upper limit (0.38 cN/dtex) of the target range, the controller 31 increases a speed of letting off the warps 1 by the let-off beam 3, or decreases a speed of winding the textile 11 by the textile winding beam 15. This can reduce the tension of the warps 1. The tension of the warps 1 can be set within the target range by performing the above-described control.

The present embodiment allows for weaving the textile 11 having an increased density of the wefts 2. By covering feathers with such a textile 11, the feathers can be prevented from coming out from between the yarns of the textile 11. According to the conventional techniques, a textile is subjected to calendering (heating and pressing) so as to reduce a gap between yarns. According to the present embodiment, however, such calendering can be omitted since the density of the wefts 2 can be increased. The omission of the calendering can reduce the number of treatment processes for the textile 11.

Second Embodiment

Figure 7:
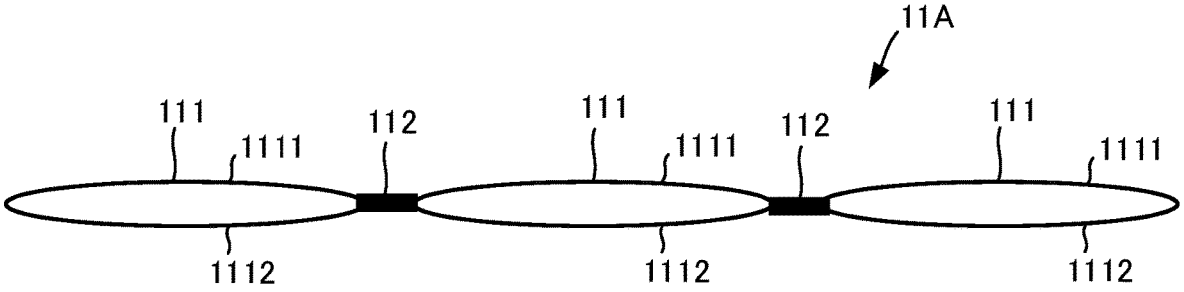
FIG. 7 is a diagram roughly illustrating a structure of an ultrahigh-density double plain-woven lateral opening bag-shaped textile.

In the present embodiment, an ultrahigh-density double plain-woven lateral opening bag-shaped textile 11A (hereinafter, referred to as a textile 11A) is made with the loom 100 as illustrated in FIG. 7. The textile 11A includes two-layered portions 111 and binding portions 112. The two-layered portion 111 includes two plain-woven textile pieces 1111 and 1112. Upstream edges of the two plain-woven textile pieces 1111 and 1112 in a winding direction (the horizontal direction in FIG. 7) of the warps 1 are bound together by the binding portion 112. Downstream edges of the textiles 1111 and 1112 in the winding direction of the warps 1 are also bound together by the binding portion 112. Consequently, the two-layered portion 111 has a bag shape.

The binding portion 112 binds the two-layered portions 111 together. Feathers, for example, are enclosed in the two-layered portion 111. According to the present embodiment, the strength of the textile 11A can be easily obtained since the textiles 1111 and 1112 overlap each other in the two-layered portion 111.

The tension of the warps 1 when the peddles 6 were located at the center C was set to 0.35 cN/dtex (the present embodiment), 0.30 cN/dtex (Comparative Example 1), or 0.25 cN/dtex (Comparative Example 2), and weaving performance of the loom 100 was measured. As a result, the weaving performance as shown in Table 2 below was obtained. The controller 31 corrects the rotational speeds of the let-off beam 3 and the textile winding beam 15 so that the tension of the warps 1 has the set value.

(1) Target value for the number of stops: 7 times/loom/24 hours or less (2) Target value for operating rate: 95% or more (3) Target value for gray fabric failure points: 13 points or less (4) Target value for A-ranked fabric rate: 97% or more The present embodiment satisfied all the above-described target values (1) to (4). The loom 100 of the present embodiment can therefore weave the textile 11A having a very high down-proof property. Also, it can be seen that the loom 100 of the present embodiment has a sufficient level of mass productivity since the target values (1) to (4) are satisfied.

When a feather product is produced, the textile 11A is subjected to a water repellent treatment.

In the present embodiment, a smoothing agent is added to a water repellent treatment liquid used in the water repellent treatment. In addition to a water repellent agent and the smoothing agent, the water repellent treatment liquid contains a cross-linker and a penetrating agent. As examples of the water repellent agent, those having six carbons may be employed. When the water repellent treatment is performed, the water repellent treatment liquid at 170° C. is applied to the textile 11A with the textile 11A being moved at a speed of 30 m/min.

TABLE 2

| CLASSIFICATIONS | | | PRESENT EXAMPLE | COMPARATIVE EXAMPLE 1 | COMPARATIVE EXAMPLE 2 |
|---|---|---|---|---|---|
| TEXTILE | | | ULTRAHIGH-DENSITY DOUBLE PLAIN-WOVEN LATERAL OPENING BAG-SHAPED TEXTILE | | |
| LOOM CONDITIONS | LOOM | | WATER JET DOBBY LOOM 16 HEDDLES LOOM WIDTH = 180 cm | | |
| | SPEED OF ROTATION | | 400 | | |
| | NUMBER OF ROTATIONS/MINUTE | | | | |
| | YARNS (WARP × WEFT) | | PET, DTY SD55-144 × PET, DTY SD55-144 | | |
| | WARP TENSION cN/dtex | | 0.35 | 0.30 | 0.25 |
| | DENSITY ON LOOM (NUMBER OF YARNS/INCH) (CRITICAL WEFT DENSITY) (WARP × WEFT) | | 350 × 280 | 350 × 260 | 350 × 240 |
| | COVER FACTOR (WARP + WEFT) | | 2,596 + 2,077 = 4,673 | 2,596 + 1,928 = 4,524 | 2,596 + 1,780 = 4,376 |
| | COVER FACTOR RATIO (WARP × WEFT) | | 56:44 | 57:43 | 59:41 |
| CAUSES FOR STOPS | WARP BREAKAGE | NUMBER OF STOPS/ LOOM/24 HOURS | 1.0 | 0.8 | 0.5 |
| | WARP FLUFF | | 0.4 | 0.2 | 0.1 |
| | WEFT BREAKAGE | | 0.8 | 0.7 | 0.8 |
| | TIP ENTANGLEMENT | | 0.9 | 0.9 | 0.7 |
| | OTHERS | | 3.2 | 2.6 | 2.6 |
| | TOTAL NUMBER OF STOPS | | 6.3 | 5.2 | 4.7 |
| OPERATING RATE % | | | 96.1 | 96.7 | 97.8 |
| GRAY FABRIC | GRAY FABRIC FAILURE POINTS/100 m | | 12.9 | 12.0 | 11.4 |
| | PASSED FABRIC RATE | | 96.3 | 97.6 | 98.2 |
| FINISH | DENSITY AFTER DYED NUMBER OF YARNS/INCH (WARP × WEFT) | | 416 × 356 | 418 × 325 | 420 × 283 |
| | COVER FACTOR (WARP + WEFT) | | 3,085 + 2,640 = 5,725 | 3,100 + 2,410 = 5,510 | 3,114 + 2,099 = 5,213 |
| | COVER FACTOR RATIO (WARP × WEFT) | | 54:46 | 56:44 | 60:40 |
| | A-RANKED FABRIC RATE | | 97.1 | 97.7 | 98.3 |
| EVALUATIONS | Down Proof Test (AATCC METHOD) | | ○ NO PROTRUDED FEATHERS | Δ VERY LITTLE BUT SOME PROTRUDED FEATHERS OBSERVED | x PROTRUDED FEATHERS OBSERVED |
| WEAVING TEST LENGTH m | | | 1,000 m | 1,000 m | 200 m |

As shown in Table 2, a down proof test for measuring protruded feathers was conducted according to an AATCC (American Association of Textile Chemists and Colorists) method. In this measurement, 90 wt % of down and 10 wt % of small feathers were mixed together and enclosed in the two-layered portion 111. In the present embodiment, no protrusion was observed due to its high yarn density. In Comparative Examples 1 and 2, on the other hand, protrusion of feathers was observed.

In general, when weaving performance of the loom 100 is evaluated, the evaluation is made on the basis of the number of stops (the total number of stops) of the loom 100, and an A-ranked fabric rate (a rate of high-quality fabrics) in gray fabrics (the textiles 11A before being dyed). Target values in mass production conditions of the loom 100 will be shown below.

The tear strengths of the textiles 11A having been subjected to a water repellent treatment using a water repellent treatment liquid without the addition of a smoothing agent were measured, and results of the measurements were as shown in Table 3 below. The tear strengths were measured according to JIS L1096 D.

TABLE 3

| | TEAR STRENGTH (Kg) | |
|---|---|---|
| | WARP DIRECTION | WEFT DIRECTION |
| PLAIN-WOVEN FABRIC | 1.4 | 0.9 |
| TWO-LAYERED FABRIC (SINGLE PIECE) | 0.9 | 0.6 |
| TWO-LAYERED FABRIC (TWO PIECES) | 2.3 | 1.4 |

The plain-woven fabric in Table 3 corresponds to the plain-woven textile 11 of the first embodiment, which was woven with the loom 100. The two-layered fabric (a single piece) in Table 3 corresponds to a textile piece 1111 (or 1112) that constitutes the two-layered portion 111 in the textile 11A of the present embodiment, which was woven with the loom 100. The two-layered fabric (two pieces) in Table 3 corresponds to the two-layered portion 111 in the textile 11A of the present embodiment, which was woven with the loom 100. The two-layered portion 111 has a bag shape with both edges of the two textile pieces 1111 and 1112 being bound together.

As shown in Table 3, the tear strength of the plain-woven fabric in the weft direction was smaller than or equal to 1 kg. The tear strengths of the two-layered fabric (a single piece) in the warp direction and the weft direction were both smaller than or equal to 1 kg. The tear strengths of the two-layered fabric (two pieces) in the warp direction and the weft direction were both larger than or equal to 1 kg.

Reference tear strengths of the textile 11 are generally 1 kg both in the warp direction and the weft direction regardless of differences in yarn thickness, textile construction, or finishing method. That is, the textile 11 is required to have a tear strength of 1 kg or more. As can be seen from the measurement results of Table 3, the plain-woven fabric and the two-layered fabric (a single piece) have insufficient tear strengths.

The tear strengths of the textiles 11, each having been subjected to a water repellent treatment using a water repellent treatment liquid with the addition of 1 to 3 wt % of a smoothing agent, were measured. The same measuring method as the method used when the measurement results shown in Table 3 were obtained was employed. Results of the measurements were as shown in Table 4 below. Note that water repellency was measured according to JIS L1092. The "L0" in the section of water repellency in Table 4 stands for laundry 0, i.e., meaning that no laundry has been done.

TABLE 4

| | SMOOTHING AGENT (1 WT %) | | SMOOTHING AGENT (2 WT %) | | SMOOTHING AGENT (3 WT %) | |
|---|---|---|---|---|---|---|
| | TEAR STRENGTH (kg) WARP DIRECTION × WEFT DIRECTION | WATER REPELLENCY | TEAR STRENGTH (kg) WARP DIRECTION × WEFT DIRECTION | WATER REPELLENCY | TEAR STRENGTH (kg) WARP DIRECTION × WEFT DIRECTION | WATER REPELLENCY |
| PLAIN-WOVEN FABRIC | 1.8 × 0.95 | L0 GRADE 5 | 2.2 × 1.9 | L0 GRADE 5 | 2.5 × 2.3 | L0 GRADE 4 |
| TWO-LAYERED FABRIC (SINGLE PIECE) | 1.5 × 1.0 | L0 GRADE 5 | 1.7 × 1.3 | L0 GRADE 5 | 2.0 × 1.7 | L0 GRADE 4 |
| TWO-LAYERED FABRIC (TWO PIECES) | 3.1 × 2.0 | L0 GRADE 5 | 3.5 × 2.7 | L0 GRADE 5 | 4.0 × 3.1 | L0 GRADE 4 |

As shown in Table 3, the plain-woven textile 11, when subjected only to the water repellent treatment without the addition of the smoothing agent, had a tensile strength of 1.4×0.9 Kg (the warp direction×the weft direction, the same applies hereinafter). By adding 1 wt % of the smoothing agent to the plain-woven textile 11 in the water repellent treatment, however, such a plain-woven textile 11 had a tear strength of 1.8×0.95 Kg as shown in Table 4. Thus, it can be seen that this can improve the tear strength. Also, by adding 2 wt % of the smoothing agent to the plain-woven textile 11 in the water repellent treatment, such a plain-woven textile 11 had a tear strength of 2.2×1.9 Kg. By adding 3 wt % of the smoothing agent to the plain-woven textile 11 in the water repellent treatment, such a plain-woven textile 11 had a tear strength of 2.5×2.3 Kg.

As just described, it can be seen that the tear strength of the plain-woven textile 11 can be raised to the reference value (1 kg) or more by adding 2 wt % or more of the smoothing agent in the water repellent treatment.

Similarly, the two-layered (a single piece) textile 11A (the single textile piece 1111 that constitutes the two-layered portion 111) had a tear strength of 0.9×0.6 Kg when subjected only to the water repellent treatment without the addition of the smoothing agent as shown in Table 3. By adding 1 wt % of the smoothing agent to the two-layered (a single piece) textile 11A in the water repellent treatment, however, such a textile 11A had a tear strength of 1.5×1.0 Kg as shown in Table 4. Thus, it can be seen that this can improve the tear strength. Also, by adding 2 wt % of the smoothing agent to the two-layered (a single piece) textile 11A in the water repellent treatment, such a textile 11A had a tear strength of 1.7 ×1.3 Kg. By adding 3 wt % of the smoothing agent to the two-layered (a single piece) textile 11A in the water repellent treatment, such a textile 11A had a tear strength of 2.0×2.7 Kg.

As just described, it can be seen that the addition of 2 wt % or more of the smoothing agent to the two-layered (a single piece) textile 11A allows the tear strength thereof to be raised sufficiently to the reference value (1 kg) or more. Note that the tear strength of the two-layered (two pieces) textile 11A was able to be further improved by adding the smoothing agent in the water repellent treatment as compared to the case without the addition of the smoothing agent.

Since the textile 11 of the first embodiment has an increased density of the wefts 2, a pressure at a point of contact between the warp 1 and the weft 2 increases. This makes the textile 11 stiff, thereby possibly lowering the tear strength of the textile 11. According to the present embodiment, the addition of the smoothing agent to the water repellent treatment liquid can prevent a pressure at a point of contact between the warp 1 and the weft 2 from increasing. Thus, the tear strength of the textile 11A can be prevented from lowering. Therefore, the use of the smoothing agent in the water repellent treatment can improve the tear strength of the textile 11A as shown in Tables 3 and 4.

Third Embodiment

In the present embodiment, an ultrahigh-density double plain-woven lateral opening bag-shaped textile 11B was made with the loom 100, and then subjected to dyeing. In the present embodiment, the textiles 11B having, after being dyed, cover factors of 5725 (Example 1), 5562 (Example 2), and 5058 (a comparative example) were made with the loom 100. Here, since the textile 11B is a two-layered fabric, a cover factor in a single-layered fabric corresponds to a half value of the cover factor in the two-layered fabric. In view of this, the cover factors in the two-layered fabrics are converted to cover factors in the single-layered fabrics, thereby obtaining 2862.5 (Example 1), 2781 (Example 2), and 2529 (the comparative example). Feathers (90 wt % of down and 10 wt % of small feathers were mixed together) were enclosed in the dyed textiles 11B in Example 1, Example 2, and the comparative example. Thereafter, a down proof test was conducted according to the AATCC method to measure protruded feathers in each of the textiles 11B in Example 1, Example 2, and the comparative example. Results of the measurements were as shown in Table 5 below. The tension of the warps 1 in the loom 100 when the textile 11B was made was set to 0.35 CN/dtex. Polyester yarns having the same thickness were used as the warp 1 and the weft 2.

A cover factor (CF) is an index representing a gap between yarns. The calculation formula of a cover factor is as follows.

$$CF=T\times(DT)^{1/2}+W\times(DW)^{1/2}$$

T: Warp density of textile (the number of warps/2.54 cm)
W: Weft density of textile (the number of wefts/2.54 cm)
DT: Thickness of warp (dtex)
DW: Thickness of weft (dtex)

As can be seen in Table 2 above, the cover factors of the dyed textiles become higher than values upon weaving (on the loom) since the textiles shrink during the dyeing.

therefore be seen that the protrusion of feathers occurs when a cover factor obtained after dyeing is smaller than 5520 (2760 in a single-layered fabric), and no protrusion of feathers occurs when a cover factor obtained after dyeing is larger than or equal to 5520 (2760 in a single-layered fabric).

If feathers are covered with the textile 11B having a cover factor smaller than 5520 (2760 in the single-layered fabric), some feathers come out from between the yarns of the textile 11B. Since the cover factors in Examples 1 and 2 are larger than or equal to 5520 (2760 in the single-layered fabric), feathers can be prevented from coming out when the feathers are covered with such textiles 11B. If the ultrahigh-density textile 11B having a cover factor of 5520 (2760 in the single-layered fabric) or more is used for clothes, such a textile 11B can prevent an acicular twig or the like from penetrating into the textile 11B even when a wearer of the clothes steps into a thicket or the like. If the ultrahigh-density textile 11B having a cover factor of 5520 (2760 in the single-layered fabric) or more is used for a surgical gown, such a textile 11B can prevent the penetration of blood.

In the textile 11B having, after being dyed, a cover factor higher than 5800 (2900 in the single-layered fabric), yarn breakage is more likely to occur at the time of weaving. Since the cover factors in Examples 1 and 2 are smaller than or equal to 5800 (2900 in the single-layered fabric), weaving can be performed in a stable manner.

Note that the diameter of the weft 2 may be set to 90 to 95% of the diameter of the warp 1. In this case, water pressure resistance can be improved as compared to the case where the weft 2 and the warp 1 have the same thickness.

TABLE 5

| CLASSIFICATIONS | | EXAMPLE 1 | EXAMPLE 2 | COMPARATIVE EXAMPLE |
|---|---|---|---|---|
| TEXTILE | | ULTRAHIGH-DENSITY DOUBLE PLAIN-WOVEN LATERAL OPENING BAG-SHAPED TEXTILE | | |
| LOOM | LOOM | WATER JET DOBBY LOOM 16 HEDDLES LOOM WIDTH = 180 cm | | |
| CONDITIONS | SPEED OF ROTATION NUMBER OF ROTATIONS/MINUTE | 400 | | |
| | WARP TENSION cN/dtex | 0.35 | 0.35 | 0.35 |
| CHARACTERISTICS | YARNS (WARP × WEFT) | PET, DTY SD55-144 × PET, DTY SD55-144 | | |
| | DENSITY AFTER DYED NUMBER OF YARNS/INCH (WARP × WEFT) | 416 × 356 | 394 × 356 | 364 × 318 |
| | COVER FACTOR (WARP + WEFT) | 3,085 + 2,640 = 5,725 | 2,922 + 2,640 = 5,562 | 2,699 + 2,359 = 5,058 |
| | COVER FACTOR RATIO (WARP × WEFT) | 54:46 | 53:47 | 53:47 |
| EVALUATIONS | Down Proof Test (AATCC METHOD) | ○ NO PROTRUDED FEATHERS | ○ NO PROTRUDED FEATHERS | x PROTRUDED FEATHERS OBSERVED |
| WEAVING TEST LENGTH m | | 1,000 m | 200 m | 200 m |

In Examples 1 and 2 respectively having cover factors of 5725 (2862.5 in the single-layered fabric) and 5562 (2781 in the single-layered fabric) after the textiles were dyed, no protruded feathers were observed due to their high yarn densities. In the comparative example having a low cover factor of 5058 (2529 in the single-layered fabric) after the textile was dyed, protruded feathers were observed. Moreover, as shown in Table 2 of the second embodiment, protruded feathers were observed also in the comparative example having a cover factor of 5213 (2606.5 in the single-layered fabric) after the textile was dyed. It can

Modified Example

While the back roller 4 is used as the "feeding roller" of the present invention in each of the above-described embodiments, the "feeding roller" of the present invention may be the tension roller 52.

While the textile winding beam 15 is used as the "winding roller" of the present invention in each of the above-described embodiments, the "winding roller" of the present invention may be the take-up roller 12. In this case, the driving of the take-up roller 12 is controlled by the controller 31.

The weft inserting unit 10 in each of the above-described embodiments adopts the water jet method. The weft inserting unit 10, however, may adopt an air jet method in which air is injected together with the weft 2, or a shuttle method in which a shuttle with one end of the weft 2 being fixed thereto is inserted into the shed 9. The weft inserting unit 10 can insert the weft 2 into the shed 9 by any appropriate method.

The driving method of the heddles 6 in each of the above-described embodiments is the tappet method in which each peddle 6 moves up or down every beating. The driving method of the heddles 6, however, may be the dobby method in which about 16 heddles 6 can be moved up and down at appropriate timing. Alternatively, the driving method of the heddles 6 may be a Jacquard method in which timing for reciprocating movements of each of a very large number of heddles 6 can be specified by a punched card.

The imaginary plane VP connecting between the center C of the heddles 6 and the fell 8 may not be a horizontal plane. The imaginary plane VP may be inclined relative to the horizontal plane or may extend along a vertical direction.

In each of the above-described embodiments, the feeding roller (the back roller 4) feeds the warps 1 to the heddles 6 from the position P displaced upward from the imaginary plane VP passing through the fell 8 and the center C. The feeding roller, however, may feed the warps 1 to the heddles 6 from a position P displaced downward from the imaginary plane VP.

In the above-described first embodiment, the tension of the warps 1 when the heddles 6 are located at the center C is set to a value larger than or equal to 0.32 cN/dtex and smaller than or equal to 0.38 cN/dtex. However, by setting the lower limit and the upper limit of the tension of the warps 1 to a value of 0.32 cN/dtex or more and a value of 0.38 cN/dtex or less, respectively, the tension of the warps 1 may be set to a range of 0.32 cN/dtex or more and 0.38 cN/dtex or less.

The setting value for the tension of the warps 1 may be set to a single value larger than or equal to 0.32 cN/dtex and smaller than or equal to 0.38 cN/dtex. The controller 31 may monitor the tension of the warps 1 and correct the rotational speeds of the let-off beam 3 and the textile winding beam 15 with the setting value being used as a target value of the warps 1.

The controller 31 may not monitor the tension of the warps 1, and the controller 31 may rotate each of the let-off beam 3 and the textile winding beam 15 at a constant speed, or may change periodically the rotational speeds of the let-off beam 3 and the textile winding beam 15. In this case, the tension of the warps 1 when the peddles 6 are located at the center C is set to 0.32 cN/dtex or more and 0.38 cN/dtex before the start of weaving. Alternatively, no controller 31 may be provided, and the let-off beam 3 and the textile winding beam 15 may each rotate at a constant speed or may each rotate at a periodically-changing rotational speed.

The present invention may be implemented in various other forms without departing from the spirit or major characteristics of the present invention. The aforementioned embodiments are therefore illustrative only in every way and should not be construed as limiting the present invention. The scope of the present invention is indicated by the claims and is not limited by the text of the description in any way. Furthermore, it is to be understood that all variations, various improvements, alternatives, and modifications pertaining to equivalents to the claims fall within the scope of the present invention.

REFERENCE SIGNS LIST

1 . . . warp, 2 . . . weft, 3 . . . let-off beam, 4 . . . back roller (feeding roller), 6 . . . heddle, 7 . . . reed, 8 . . . fell, 9 . . . shed, 10 . . . weft inserting unit, 15 . . . textile winding beam (winding roller), 31 . . . controller, 100 . . . loom, C . . . center, VP . . . imaginary plane

The invention claimed is:

1. A loom comprising:

a plurality of heddles that separate a part of a plurality of warps from the other part of the plurality of warps to form a shed between the part of the warps and the other part of the warps, each of the warps being a polyester yarn;

a weft inserting unit that makes a weft pass through the shed, the weft being a polyester yarn;

a reed that presses the weft, having been passed through the shed, against a fell to make a textile;

a feeding roller that feeds the warps to the heddles from a position displaced from an imaginary plane passing through a center of a moving range of the heddles and the fell;

a let-off beam that feeds the warps to the feeding roller; and a textile winding beam that winds the textile, wherein a tension of the warps when the heddles are located at the center is set to 0.32 cN/dtex or more and 0.38 cN/dtex or less.

2. The loom according to claim 1, comprising a controller that monitors the tension of the warps, and controls a rotational speed of at least one of the let-off beam and the textile winding beam so that the tension of the warps when the heddles are located at the center has a value larger than or equal to 0.32 cN/dtex and smaller than or equal to 0.38 cN/dtex.

3. A method for producing a textile, comprising:

feeding a plurality of warps to heddles from a position displaced from an imaginary plane connecting between a center of a moving range of the heddles and a fell by a feeding roller, each of the warps being a polyester yarn;

separating a part of the plurality of warps from the other part of the plurality of warps by the heddles to forma shed between the part of the warps and the other part of the warps; and pressing a weft, which is a polyester yarn and has been passed through the shed, against a fell to make a textile, wherein a tension of the warps when the heddles are located at the center is set to 0.32 cN/dtex or more and 0.38 cN/dtex or less.

4. The method for producing a textile according to claim 3, comprising applying a water repellent treatment liquid containing 2 wt % or more of a smoothing agent to the textile.

* * * * *